US006827133B1

(12) United States Patent
Luo

(10) Patent No.: US 6,827,133 B1
(45) Date of Patent: Dec. 7, 2004

(54) HEAT PIPE

(76) Inventor: Chin-Kuang Luo, 5F, No. 56, Min-Chuan Rd., Chung Dist., Taichung (TW)

( * ) Notice: Subject to any disclaimer, the term of this patent is extended or adjusted under 35 U.S.C. 154(b) by 0 days.

(21) Appl. No.: 10/684,111

(22) Filed: Oct. 10, 2003

(30) Foreign Application Priority Data

May 8, 2003 (TW) ..... 92208421 U

(51) Int. Cl.[7] ..... F28F 15/00

(52) U.S. Cl. ..... 165/104.21; 165/104.21; 165/104.33; 361/700; 257/715; 174/15.2

(58) Field of Search ..... 165/104.21, 104.26, 165/104.33, 185; 361/699, 700; 257/714–716; 174/15.2; 29/890.032

(56) References Cited

U.S. PATENT DOCUMENTS 3,613,773 A * 10/1971 Hall et al. ..... 165/273
5,582,242 A * 12/1996 Hamburgen et al. ... 165/104.21
5,632,158 A * 5/1997 Tajima ..... 62/259.2
6,725,909 B1 * 4/2004 Luo ..... 165/104.21
2003/0066628 A1 * 4/2003 Mochizuki et al. .... 165/104.26

FOREIGN PATENT DOCUMENTS

JP 60-42593 * 3/1985 ..... 165/104.26

* cited by examiner

*Primary Examiner*—Terrell Mckinnon
(74) *Attorney, Agent, or Firm*—Trop, Pruner & Hu, P.C.

(57) ABSTRACT

A heat pipe includes a tubular body, a heat transfer fluid, and a heat sink member. The tubular body has opposite bottom and top ends, a peripheral wall between the bottom and top ends, and an inner chamber defined by the bottom and top ends and the peripheral wall for receiving the fluid therewithin. The heat sink member has a bottom face adapted to contact a heat source, and a top face indented downwardly to define a fluid accumulating portion. The fluid in the fluid accumulating portion absorbs heat from the heat source and vaporizes to carry heat away from the heat source.

13 Claims, 15 Drawing Sheets

HEAT PIPE

CROSS-REFERENCE TO RELATED APPLICATION

This application claims priority of Taiwanese Application No. 092208421, filed on May 8, 2003.

BACKGROUND OF THE INVENTION

1. Field of the Invention

The invention relates to a heat pipe, more particularly to a heat pipe that can transfer heat quickly.

2. Description of the Related Art

FIGS. 1 to 4 illustrate a method for producing a conventional heat pipe 1 that is suitable for dissipating heat from electronic components. The method includes the steps of providing a metallic tubular body 11 with an open end portion 111 and a peripheral wall 112 defining an inner chamber 113, introducing a suitable amount of heat transfer liquid 13 into the tubular body 11 using a filling device 12, evacuating the inner chamber 113 of the tubular body 11, pinching the open end portion 111 of the tubular body 11 by means of a machine tool 5 (see FIG. 2) so as to close the open end portion 111 and so as to form a flattened sealing portion 114 (see FIG. 2), cutting a top end section 1141 of the flattened sealing portion 114 by means of a cutting machine 3 (see FIG. 3), and sealing the heat pipe 1 by a spot welding process. A welding spot, represented by numeral 14, is shown in FIG. 4.

However, in actual use, the aforementioned flattened sealing portion 114 of the heat pipe 1 is easily broken due to an external force, thereby resulting in leakage of the heat pipe 1. Furthermore, the flattened sealing portion 114 increases the length of the heat pipe 1 such that the latter has a relatively large volume. Moreover, since the liquid 13 is first introduced into the tubular body 11 followed by the evacuation process, it is possible that some of the liquid 13 will be drawn out such that the quantity of the liquid 13 in the tubular body 11 and the quality of the heat pipe 1 cannot be accurately controlled. Additionally, the method for producing the conventional heat pipe 1 is somewhat complicated.

Most importantly, heat dissipation of the conventional heat pipe 1 involves stimulating the liquid 13 in the tubular body 11 through the rising temperature of the heat source 2, such as an integrated circuit, so that the liquid 13 gradually absorbs the heat and vaporizes, as shown by upward arrows in FIG. 4. The vaporized liquid exchanges heat with the external air through convection and then condenses into liquid, thereby achieving absorption and dissipation of heat from the heat source 2. However, although a liquid can absorb heat more rapidly than a solid, since the flat bottom of the heat pipe 1, which has a slow heat absorption rate, overlies the heat source 2 for heat exchange with the heat source 2 and for heat transfer to the liquid 13, the time required to stimulate the liquid 13 in the tubular body 11 is prolonged so that heat cannot be transferred quickly.

SUMMARY OF THE INVENTION

Therefore, the object of the present invention is to provide a heat pipe that is capable of overcoming the aforementioned drawbacks of the prior art.

According to this invention, a heat pipe comprises a tubular body, a heat transfer fluid, and a heat sink member. The tubular body has opposite bottom and top ends, a peripheral wall between the bottom and top ends, and an inner chamber defined by the bottom and top ends and the peripheral wall. The heat transfer fluid is disposed in the inner chamber. The heat sink member closes the bottom end, and has a bottom face adapted to contact a heat source. The heat sink member further has a top face directed toward the inner chamber. The top face is indented downwardly to define a fluid accumulating portion. The heat transfer fluid in the fluid accumulating portion absorbs heat from the heat source and vaporizes to carry heat away from the heat source.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
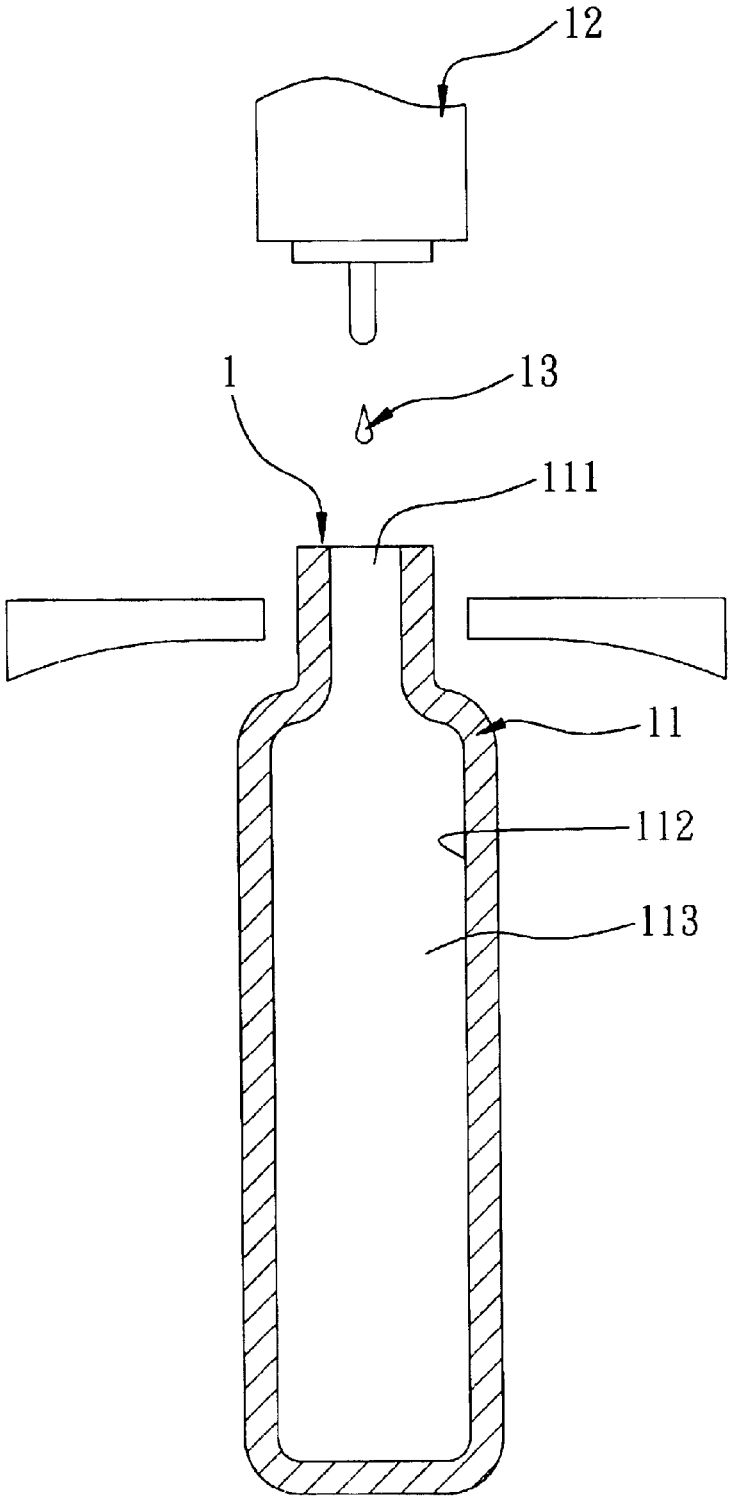
FIG. 1 PRIOR ART
FIG. 1 is a fragmentary sectional view of a conventional heat pipe, illustrating how a heat transfer liquid is introduced into the heat pipe using a filling device.
Figure 2:
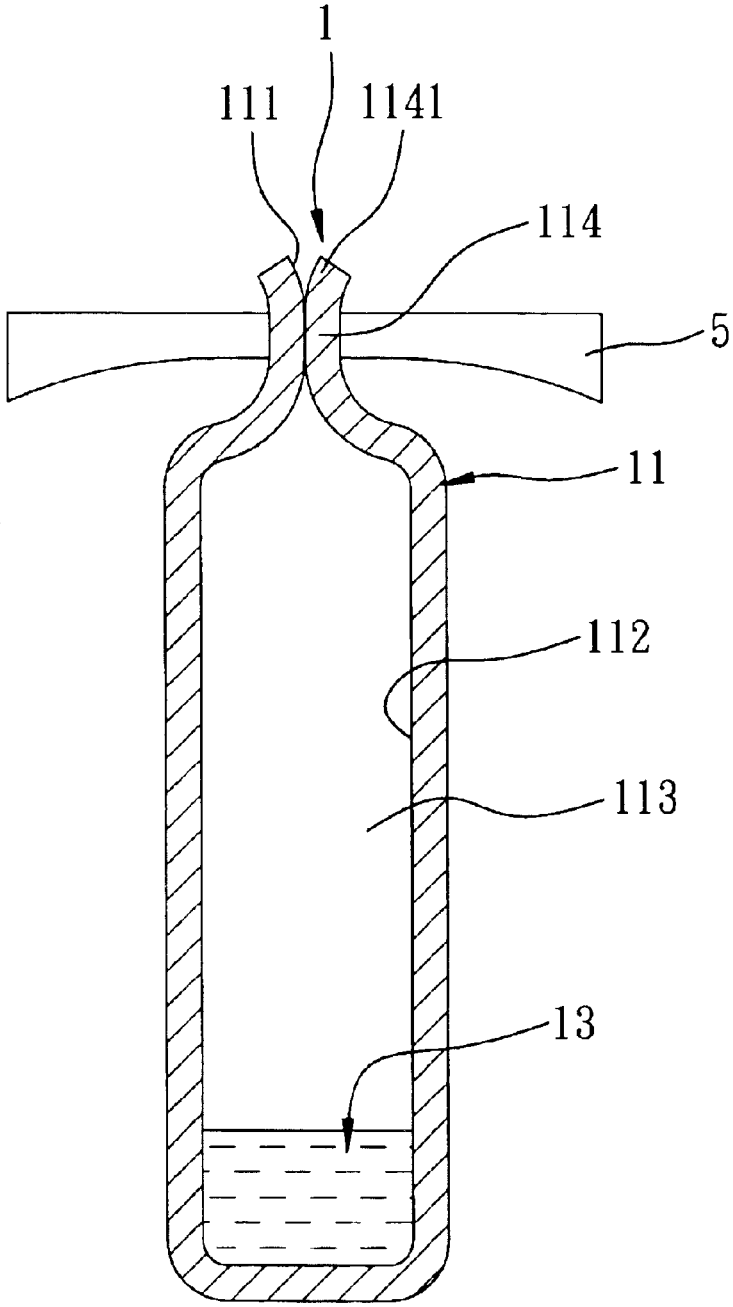
FIG. 2 PRIOR ART
FIG. 2 is another fragmentary sectional view of the conventional heat pipe, illustrating the pinching of an open end portion of the heat pipe by a machine tool to form a flattened sealing portion.
Figure 3:
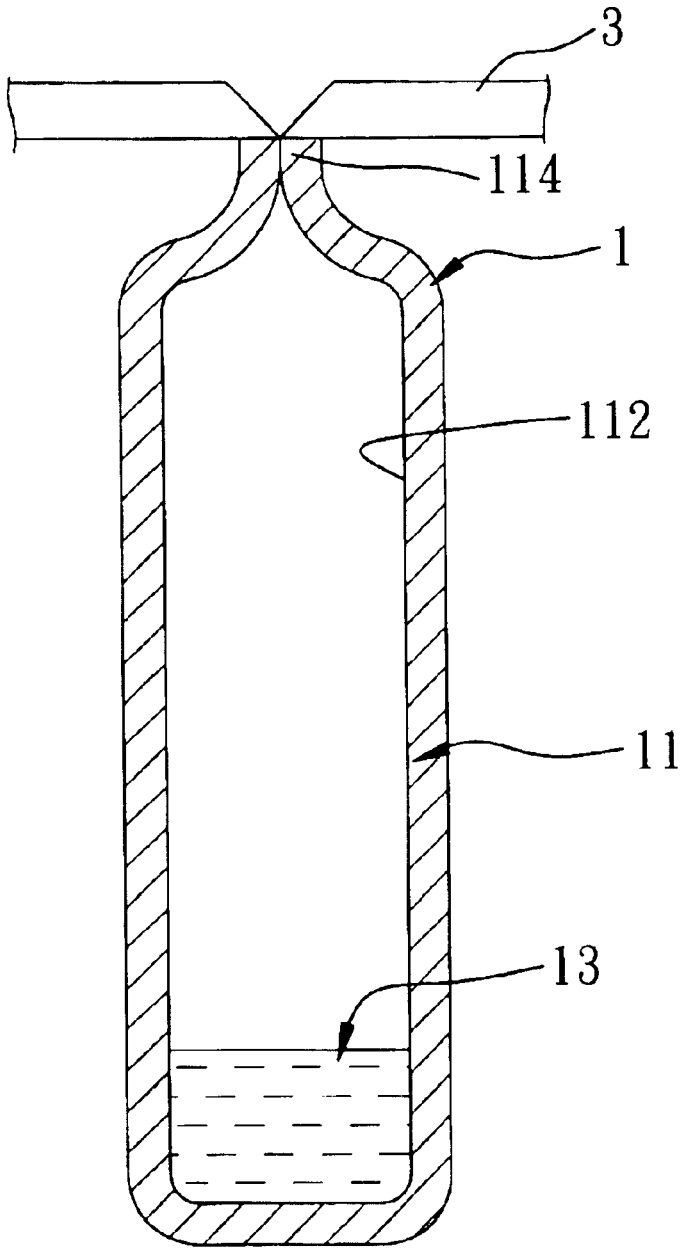
FIG. 3 PRIOR ART
FIG. 3 is yet another fragmentary sectional view of the conventional heat pipe, illustrating the flattened sealing portion after being cut by a cutting machine.
Figure 4:
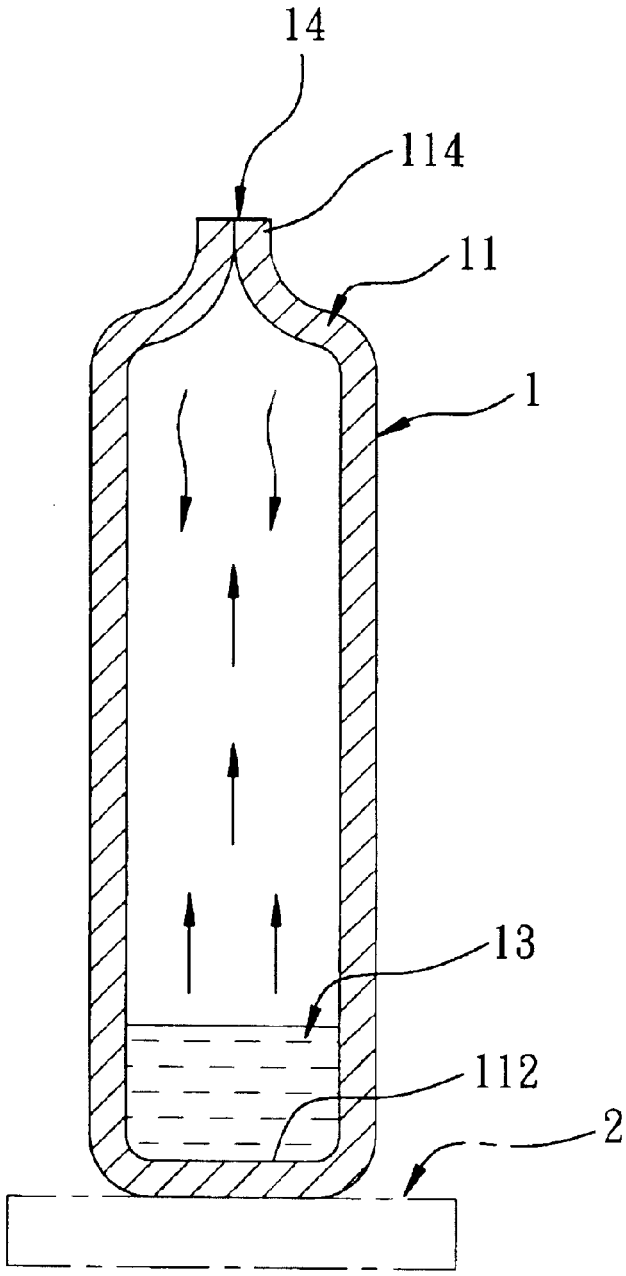
FIG. 4 PRIOR ART
FIG. 4 is a further fragmentary sectional view of the conventional heat pipe, illustrating the heat pipe after being sealed by a spot welding process.

Before the present invention is described in greater detail, it should be noted that like elements are denoted by the same reference numerals throughout the disclosure.

Figure 5:
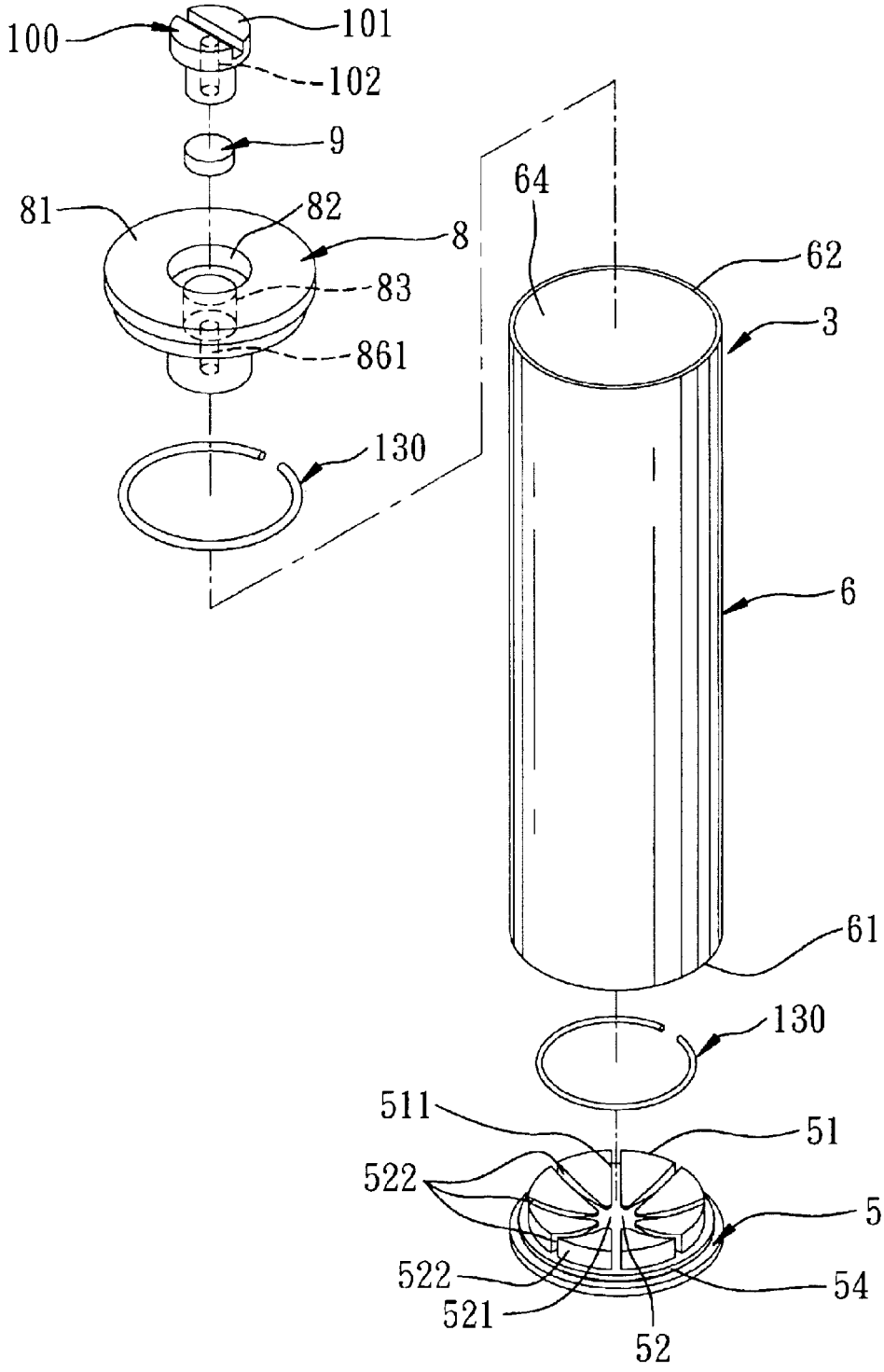
FIG. 5 is an exploded perspective view of the first preferred embodiment of a heat pipe according to the present invention.
Figure 6:
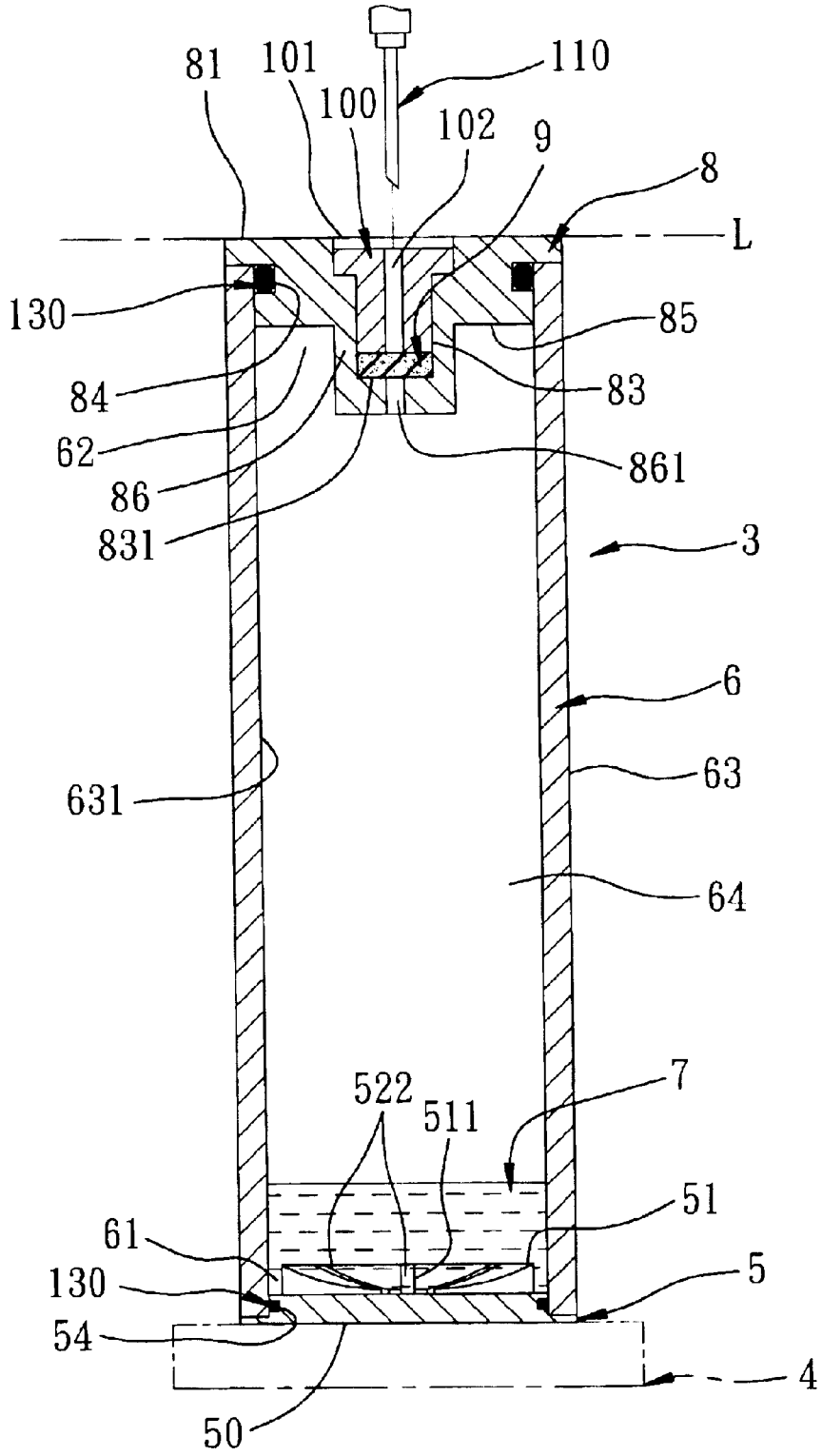
FIG. 6 is a sectional view of the first preferred embodiment in an assembled state.
Figure 7:
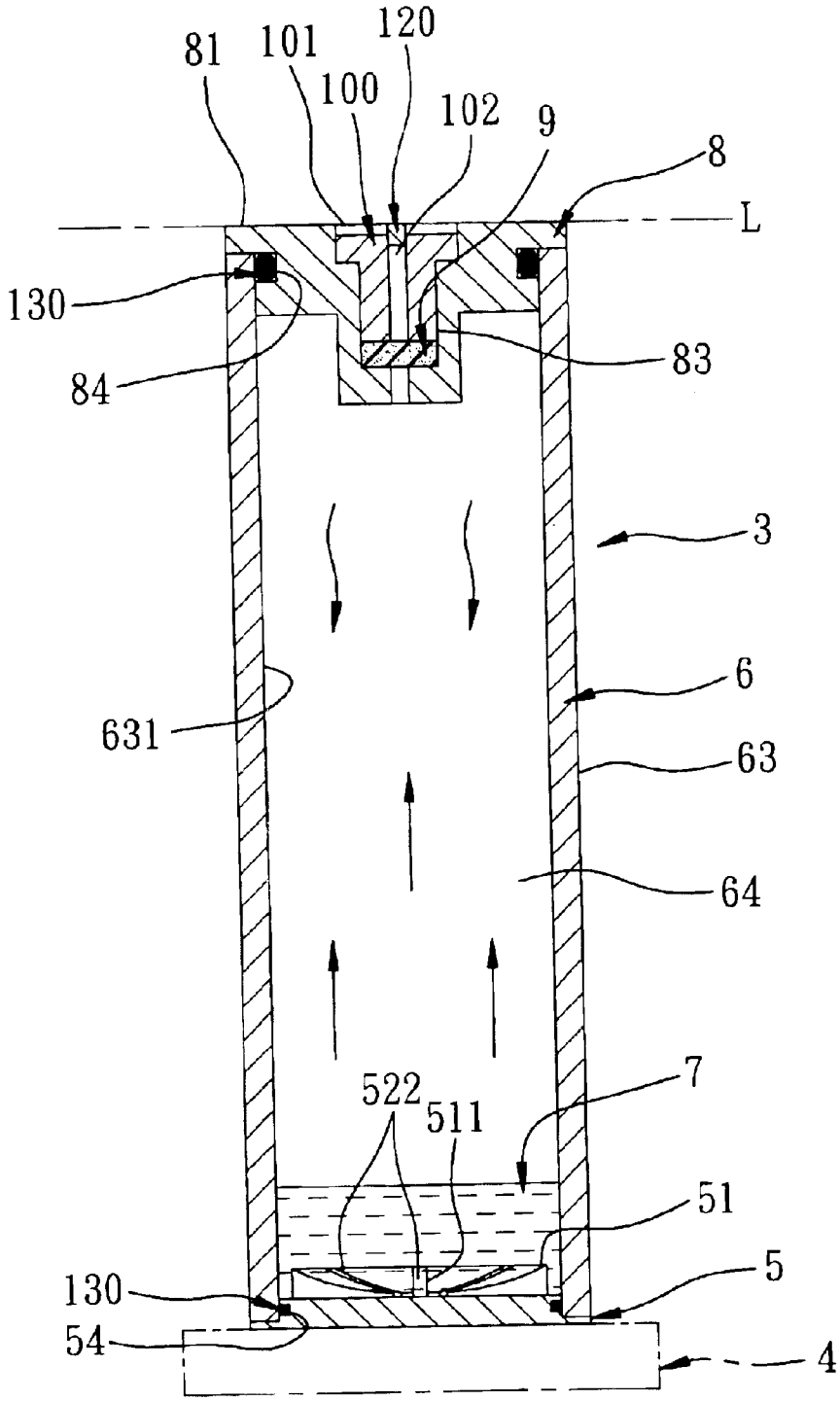
FIG. 7 is a sectional view to illustrate the tubular body of the heat pipe of the first preferred embodiment when sealed.
Figure 8:
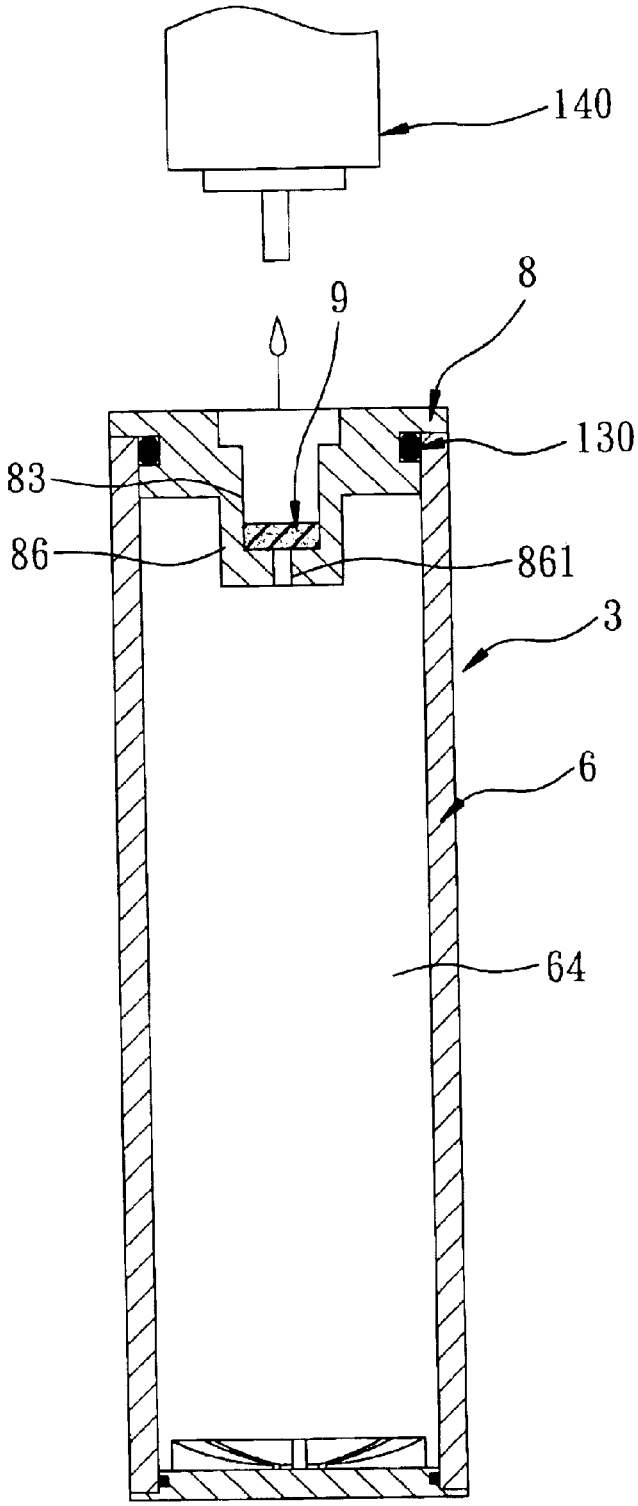
FIG. 8 is a sectional view of the second preferred embodiment of a heat pipe according to the present invention.
Figure 9:
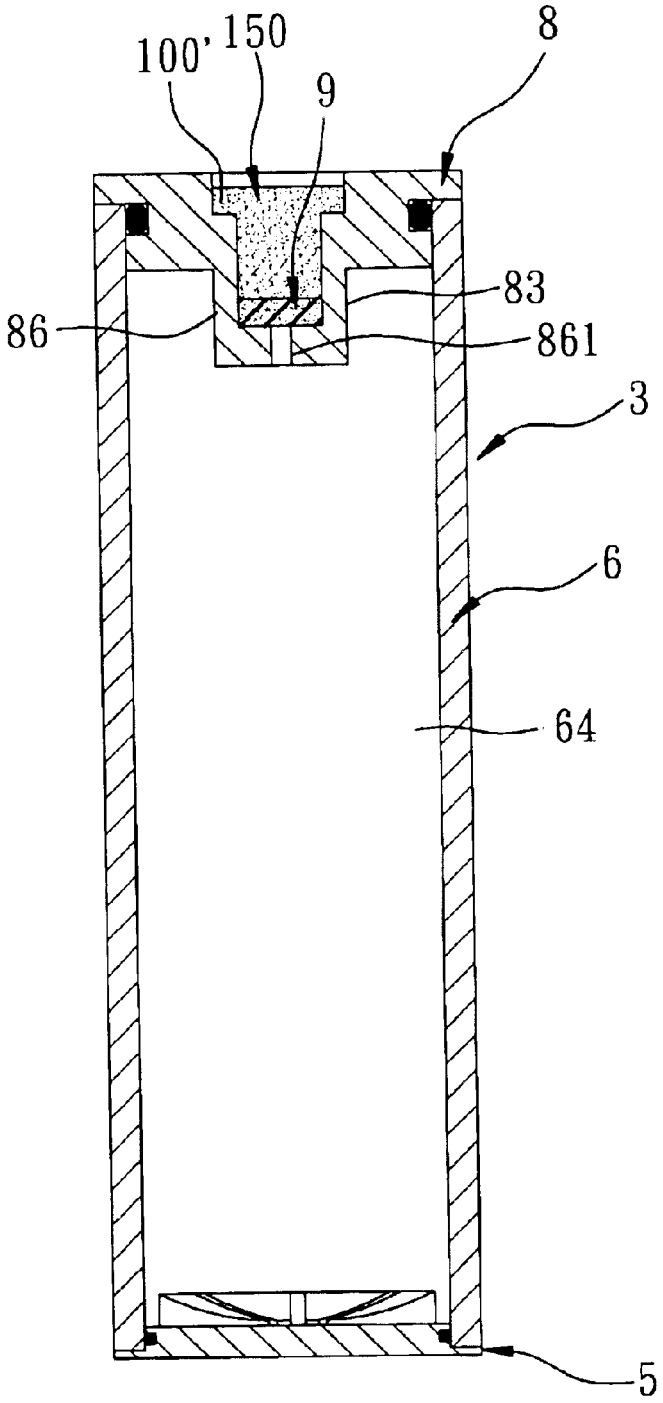
FIG. 9 is the same view as FIG. 8, but with a resin cured in a filling hole to form a securing member.
Figure 10:
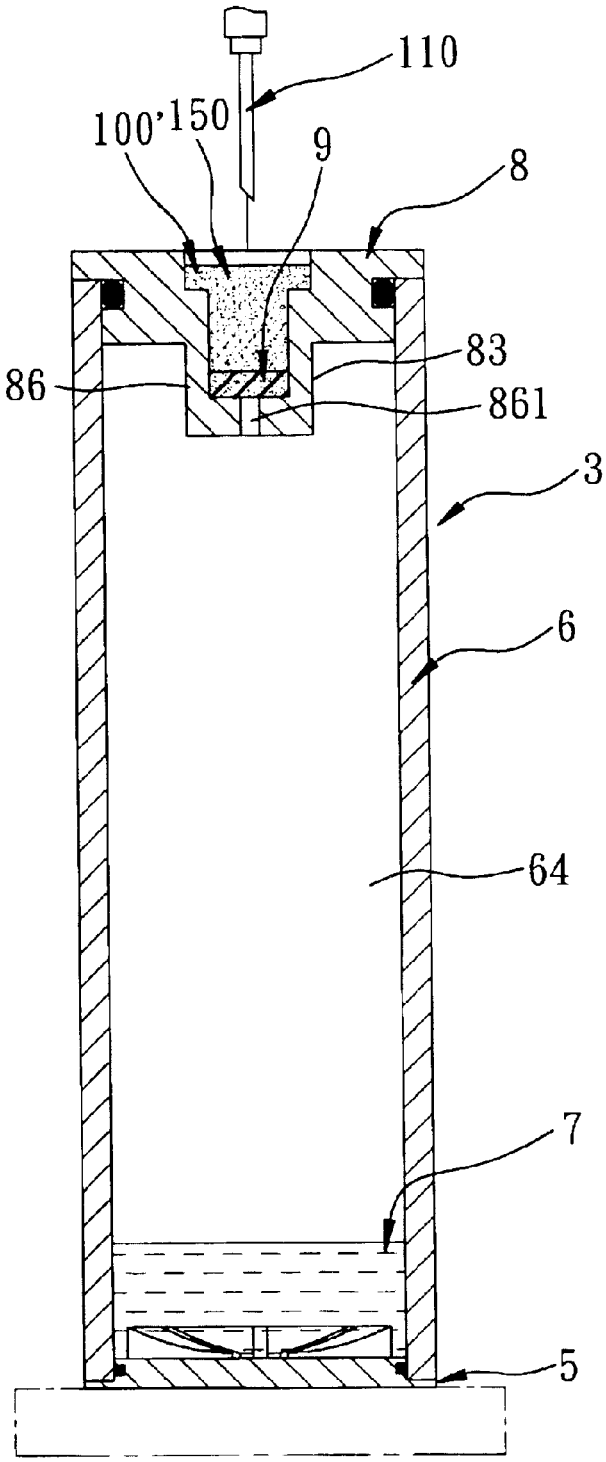
FIG. 10 is the same view as FIG. 9, but with a fluid introduced into the tubular body through a needle.
Figure 11:
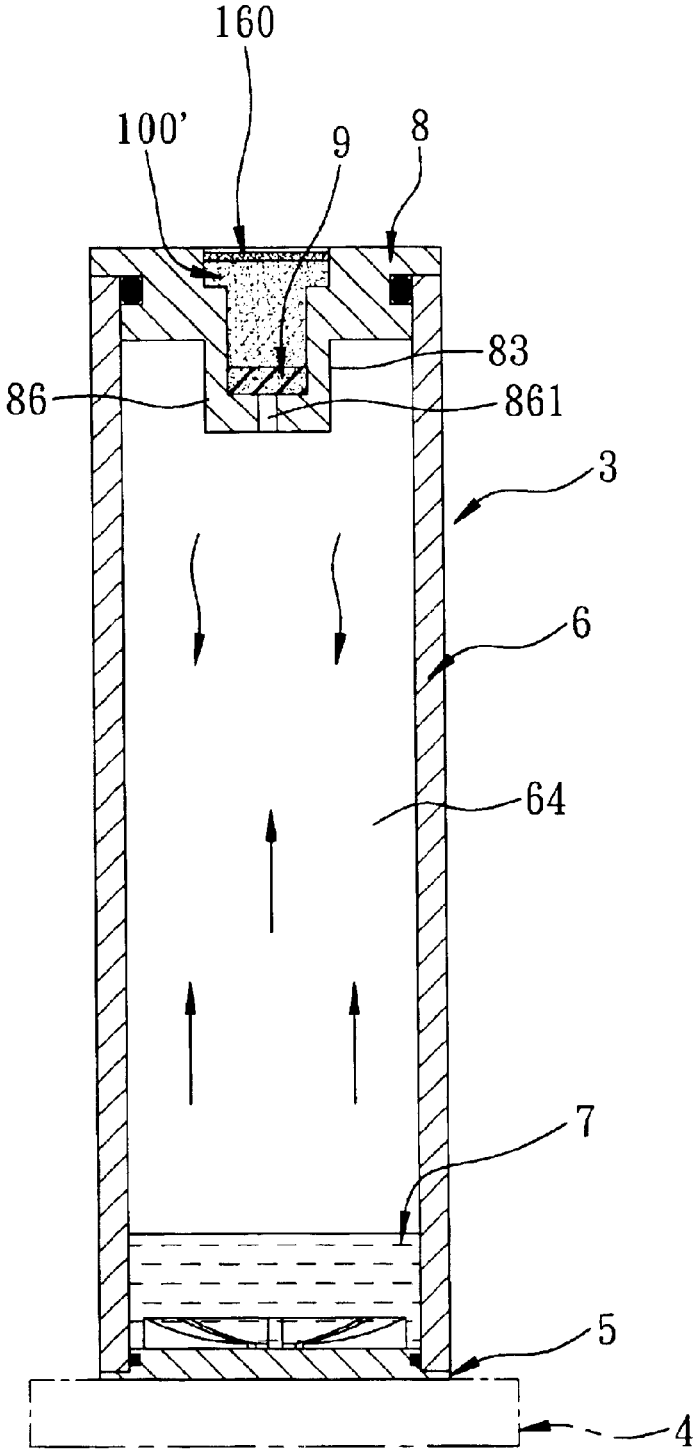
FIG. 11 is the same view as FIG. 10, after being sealed with a sealant.

Referring to FIGS. 5 to 7, the first preferred embodiment of a heat pipe 3 according to the present invention is shown to comprise a heat sink member 5, a metallic tubular body 6, a heat transfer fluid 7 (see FIG. 6), a cover member 8, an elastic sealing member 9, and a securing member 100.

The heat sink member 5 is made of a highly heat conductive metal, such as aluminum, copper, or an alloy. The heat sink member 5 has a bottom face 50 adapted to contact a heat source 4 (see FIG. 6), and a top face 51 opposite to the bottom face 50 and indented downwardly or concaved to define a fluid accumulating portion 52. The top face 51 has a central part 511 and a peripheral end 512 surrounding the central part 511, and is indented from the peripheral end 512 to the central part 511 so that the heat sink member 5 decreases in thickness from the peripheral end 512 to the central part 511. The fluid accumulating portion 52 includes a central fluid accumulating cavity 521, and a plurality of channels 522 extending outwardly from the cavity 521.

Since the indented top face 51 formed with the cavity 521 and the channels 522 provides a greater contact surface with the fluid 7 as compared with the flat bottom of the aforesaid conventional heat pipe 1, the heat sink member 5 is more efficient for heat transfer than the flat bottom of the conventional heat pipe 1. In addition, as the heat sink member 5 is thin at the central part 511, the rate of heat transfer from the heat source 4 to the fluid 7 through the heat sink member 5 can be increased as compared with the flat bottom of the conventional heat pipe 1 that has a constant thickness.

The tubular body 6 has a bottom end 61 sleeved fixedly on the heat sink member 5 so that the heat sink member 5 closes the bottom end 61, a top end 62 opposite to and in fluid communication with the bottom end 61, a peripheral wall 63 (see FIG. 6) between the bottom and top ends 61, 62, and an inner chamber 64 defined by the bottom and top ends 61, 62 and the peripheral wall 63. The top face 51 of the heat sink member 5 is directed toward the inner chamber 64.

The heat sink member 5 further has a peripheral face extending between the top and bottom faces 51, 50 and engaging an inner surface 631 of the peripheral wall 63 of the tubular body 6 at the bottom end 61 of the tubular body 6. The peripheral face is recessed to form a peripheral groove 54, and has a first braze metal wire 130 which is received in the groove 54 and which is fused to join the heat sink member 5 to the tubular body 6.

The heat transfer fluid 7 is disposed in the inner chamber 64, and can be accumulated in the fluid accumulating cavity 52 in the heat sink member 5. The fluid 7 can be water, ammonia, or any other liquid that can vaporize when heated and that can condense when cooled. The heat transfer fluid 7 in the fluid accumulating portion 52 absorbs heat from the heat source 4 and vaporizes to carry heat away from the heat source 4.

The cover member 8 is mounted fixedly on and covers the top end 62 of the tubular body 6, and has an inner side 85 (see FIG. 6) facing the inner chamber 64, an outer side 81 opposite to the inner side 85, and a filling hole 82 formed in the cover member 8, in fluid communication with the inner chamber 64, and extending through the outer side 81. The filling hole 82 is formed as a blind hole 83 which opens at the outer side 81 and which has a closed end 831 (see FIG. 6) adjacent to the inner side 85. The cover member 8 further has a seat part 86 (see FIG. 6) at the inner side 85 to bound the closed end 831. The seat part 86 has a first needle hole 861 extending through the inner side 85 and communicated with the blind hole 83. The blind hole 83 has a cross-section, which is gradually reduced from the outer side 81 to the inner side 85.

The cover member 8 further has a peripheral face extending between the outer and inner sides 81, 85 and engaging the inner surface 631 of the peripheral wall 63 of the tubular body 6 at the top end 62 of the tubular body 6. The peripheral face of the cover member 8 is recessed to form a peripheral groove 84, and has a second braze metal wire 130' that is received in the groove 84 in the cover member 8 and that is fused to join the cover member 8 to the tubular body 6.

In this embodiment, the elastic sealing member 9 is a cured sealing block fitted within the filling hole 82, and is made of an elastic material, such as a rubber or a silicone elastomer. The sealing member 9 is pierceable to provide a passage (not shown) for injection of the heat transfer fluid 7 through the sealing member 9, and is contractible to seal the passage.

The securing member 100 is fitted sealingly into the blind hole 83 and outwardly of the sealing member 9 by means of a tool (not shown) so as to press the sealing member 9 against the seat part 86 so that the outer surface 101 of the securing member 100 is flush with the outer side 81 of the cover member 8, as shown by the straight line (L) in FIG. 7, thereby sealing the first needle hole 861 and preventing air from entering the inner chamber 64 in the tubular body 6. The securing member 100 has a shape in conformity with that of the blind hole 83, a second needle hole 102 in alignment with the first needle hole 861 in the cover member 8, and an insert piece 120 (see FIG. 7) disposed sealingly in the second needle hole 102. When a needle 110 is withdrawn from the tubular body 6 and the second needle hole 102, the second needle hole 102 is closed by the insert piece 120 for enhanced airtight sealing. The insert piece 120 may be a welding spot formed by a spot welding machine (not shown), or a sealant.

Referring once again to FIG. 7, to fill the tubular body 6 with the heat transfer fluid 7, the needle 110 is extended into the inner chamber 64 in the tubular body 6 by passing through the second needle hole 102 in the securing member 100, the sealing member 9, and the first needle hole 861 in the seat part 86 of the cover member 8. The needle 110 is connected to a controlling unit (not shown), which operates to subsequently evacuate air from within the inner chamber 64 and to introduce a predetermined amount of the heat transfer fluid 7 into the inner chamber 64. When the needle 110 is withdrawn from the tubular body 6, the sealing member 9, because of its elasticity, contracts to seal the passage in the sealing member 9. Afterwards, the insert piece 120 is used to seal the second needle hole 102.

The heat sink member 5 and the cover member 8 can be fitted sealingly and respectively to the bottom and top ends 61, 62 of the tubular body 6 by a machine tool (not shown), or can be threadedly engaged to the peripheral wall 63 of the tubular body 6.

When the heat source 4, such as a central processing unit, generates heat, the heat transfer fluid 7 in the fluid accumulating portion 52 of the heat sink member 5 vaporizes quickly, as shown by upward arrows in FIG. 7, because of the indented configuration of the top face 51 of the heat sink member 5. Then, the vaporized fluid exchanges heat with the external air by convection and thus condenses and flows downward, as shown by downward arrows in FIG. 7. Furthermore, the heat pipe 3 of the present invention does not have to undergo the processes of pinching and cutting prior to sealing, has an outer appearance that is not easily broken by an external force, and a length that is shorter than that of the aforesaid conventional heat pipe 1 so that it does not occupy a relatively large amount of space. Moreover, the amount of the heat transfer fluid 7 filled in the tubular body 6 can be controlled accurately using simple processing equipment so that working quality of the heat pipe 3 of the present invention can be effectively ensured.

Referring to FIGS. 8 to 11, the second preferred embodiment of the heat pipe 3 according to the present invention is shown to be substantially similar to the first preferred embodiment. However, in this embodiment, the securing member 100' is provided by introducing a curable resin 150 into the blind hole 83 through a sealing machine 140. After the resin 150 is cured, the resulting securing member 100' is retained sealingly in the blind hole 83, and abuts sealingly against the sealing member 9 so as to press the sealing member 9 against the seat part 86. Then, the needle 110 is extended into the inner chamber 64 in the tubular body 6 by passing through the securing member 100', the sealing member 9, and the first needle hole 861 in the seat part 86 of the cover member 8 to subsequently evacuate air from within the inner chamber 64 and to introduce the heat transfer fluid 7 into the inner chamber 64. When the needle 110 is withdrawn from the tubular body 6, the securing member 100' and the sealing member 9, because of their elastic characteristics, contract to seal the passages (not shown) in the securing member 100' and the sealing member 9, after which a layer of sealant 160 is disposed sealingly and outwardly of the securing member 100', thereby preventing air from entering the inner chamber 64 in the tubular body 6.

Figure 12:
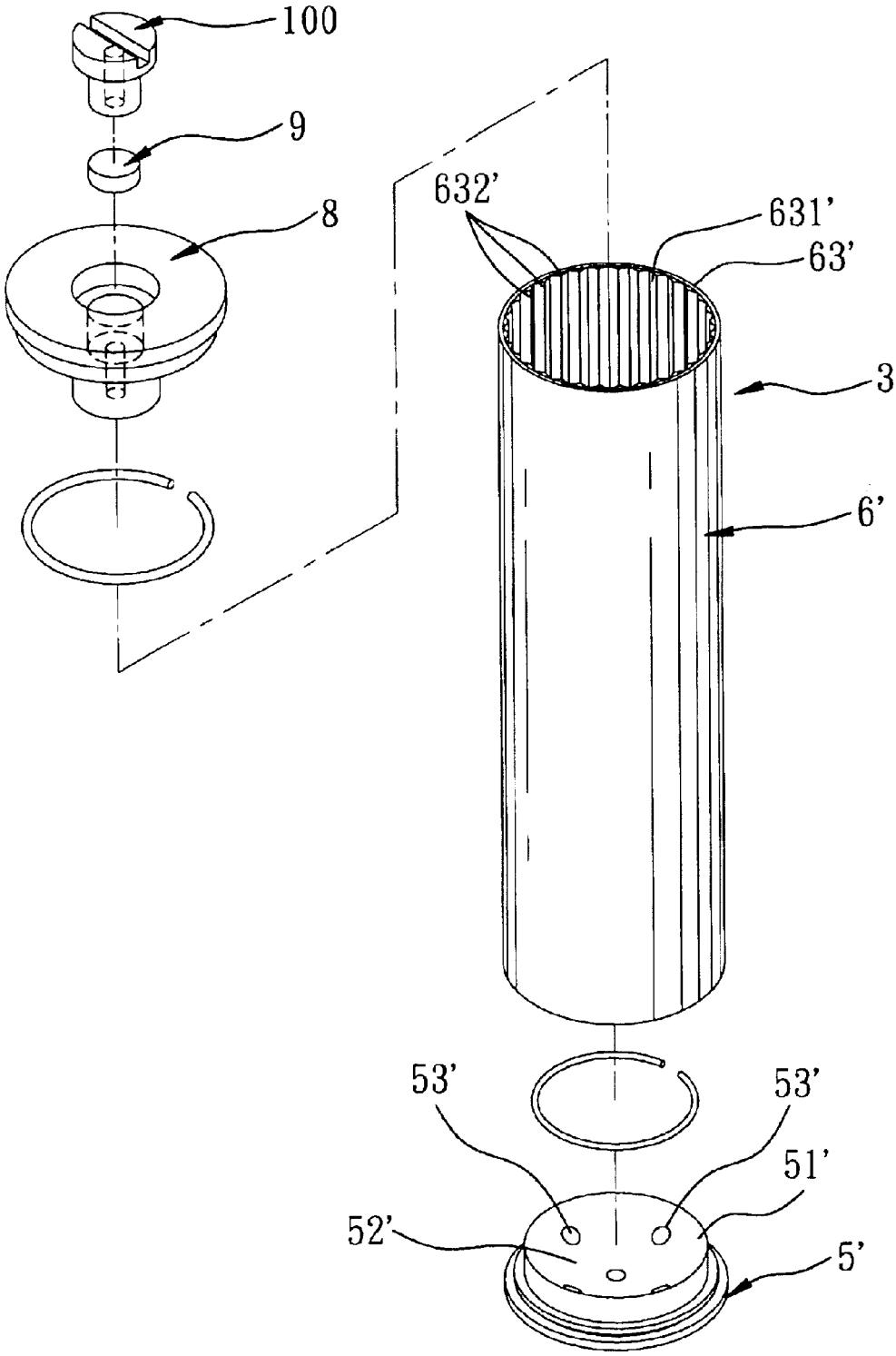
FIG. 12 is an exploded perspective view of the third preferred embodiment of a heat pipe according to the present invention.
Figure 13:
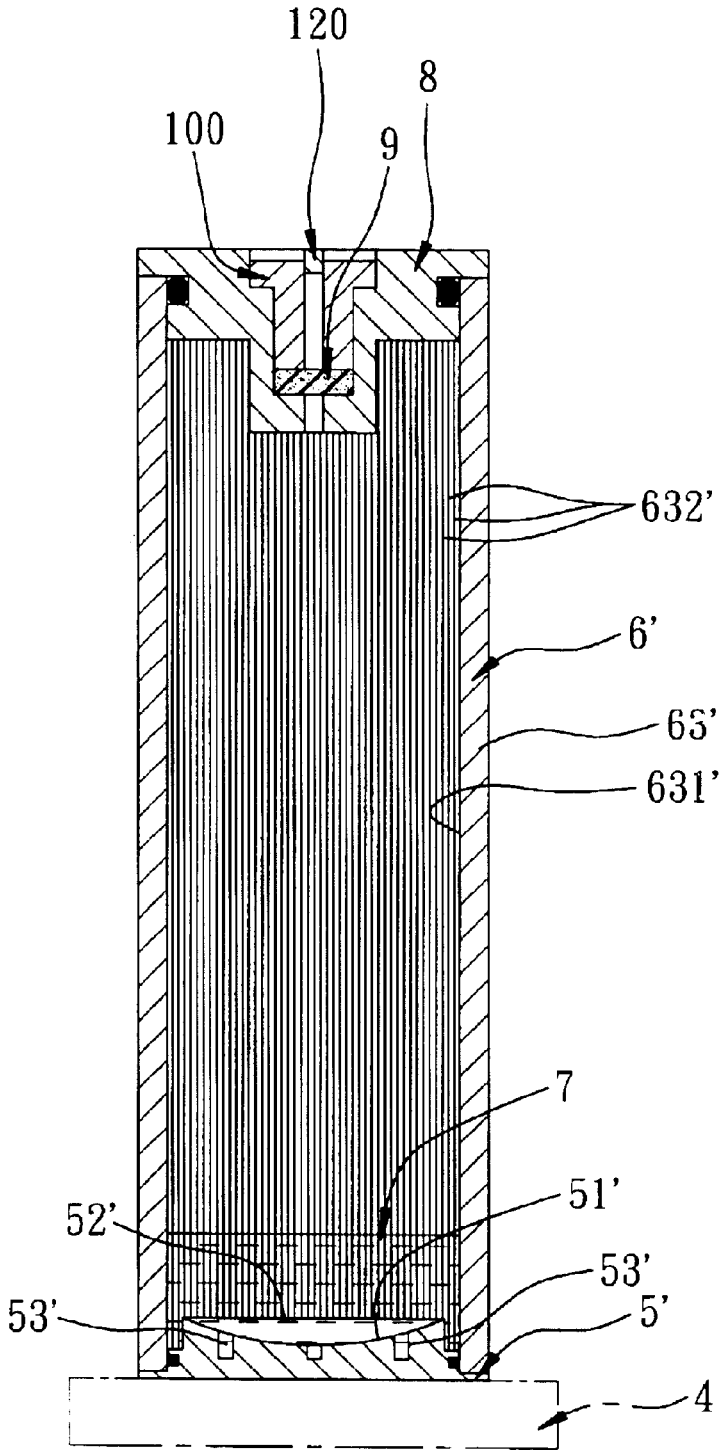
FIG. 13 is a sectional view of the third preferred embodiment in an assembled state.

Referring to FIGS. 12 and 13, the third preferred embodiment of the heat pipe 3 according to the present invention is shown to be substantially similar to the first preferred embodiment. However, unlike the first preferred embodiment, the fluid accumulating portion 52' of the heat sink member 5' in this embodiment includes a plurality of spaced-apart downward slots 53' formed in the top face 51' of the heat sink member 5'. The peripheral wall 63' of the tubular body 6' has an inner surface 631' provided with a capillary structure. The capillary structure includes a plurality of vertically and radially extending internal wicks 632'. The internal wicks 632' not only increase the internal heat transfer area of the tubular body 6', but also enhance the heat conduction effect of the heat pipe 3 of the present invention so that the heat exchange efficiency is improved.

Figure 14:
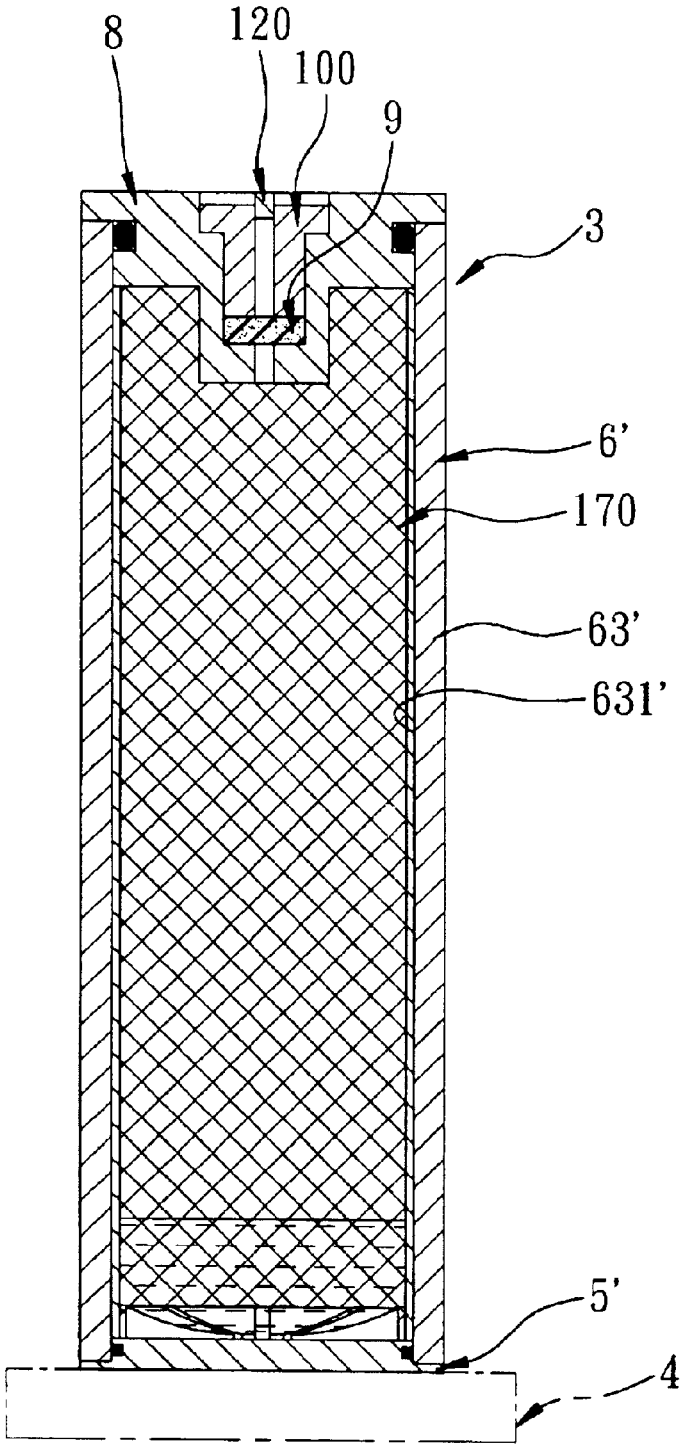
FIG. 14 is a sectional view of the fourth preferred embodiment of a heat pipe according to the present invention.

Referring to FIG. 14, the fourth preferred embodiment of the heat pipe 3 according to the present invention is shown to be substantially similar to the third preferred embodiment. However, in this embodiment, the capillary structure is a metal net 170 connected fixedly to the inner surface 631' of the peripheral wall 63' of the tubular body 6'.

Figure 15:
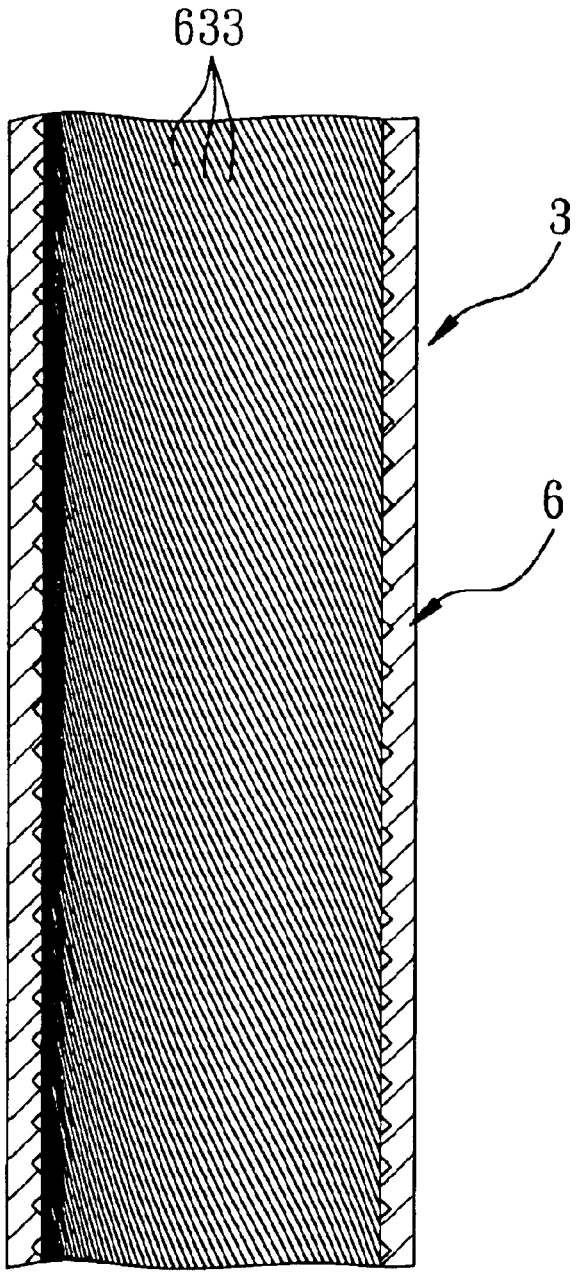
FIG. 15 is a fragmentary sectional view of the fifth preferred embodiment of a heat pipe according to the present invention.

Referring to FIG. 15, the fifth preferred embodiment of the heat pipe 3 according to the present invention is shown to be substantially similar to the third preferred embodiment. However, in this embodiment, the capillary structure includes a plurality of spiral capillary grooves 633.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A heat pipe comprising:

a tubular body having opposite bottom and top ends, a peripheral wall between said bottom and top ends, and an inner chamber defined by said bottom and top ends and said peripheral wall;

a heat transfer fluid disposed in said inner chamber; and a heat sink member closing said bottom end and having a bottom face adapted to contact a heat source, said heat sink member further having a top face directed toward said inner chamber, said top face being indented downwardly to define a fluid accumulating portion, wherein said top face has a central part and a peripheral end surrounding said central part, said top face being indented from said peripheral end to said central part so that said heat sink member decreases in thickness from said peripheral end to said central part, wherein said fluid accumulating portion of said heat sink member includes a central fluid accumulating cavity and a plurality of channels extending outwardly from said cavity, and wherein said heat transfer fluid in said fluid accumulating portion absorbs heat from the heat source and vaporizes to carry heat away from the heat source.

2. The heat pipe as claimed in claim 1, further comprising:

a cover member covering said top end, said cover member having an inner side facing said inner chamber, an outer side opposite to said inner side, and a filling hole formed in said cover member, in fluid communication with said inner chamber, and extending through said outer side; and an elastic sealing member fitted within said filling hole, wherein said elastic sealing member is pierceable to provide a passage for injection of said heat transfer fluid through said elastic sealing member, and is contractible to seal said passage.

3. The heat pipe as claim in claim 1, wherein said fluid accumulating portion of said heat sink member includes a plurality of spaced-apart downward slots formed in said top face.

4. The heat pipe as claimed in claim 1, wherein said peripheral wall of said tubular body has an inner surface formed with a capillary structure.

5. The heat pipe as claimed in claim 4, wherein said capillary structure includes a plurality of vertically and radially extending internal wicks.

6. The heat pipe as claimed in claim 4, wherein said capillary structure is a metal net connected fixedly to said inner surface of said peripheral wall.

7. The heat pipe as claimed in claim 4, wherein said capillary structure includes a plurality of spiral capillary grooves.

8. A heat pipe comprising:

a tubular body having opposite bottom and top ends, a peripheral wall between said bottom and top ends, and an inner chamber defined by said bottom and top ends and said peripheral wall;

a heat transfer fluid disposed in said inner chamber; and a heat sink member closing said bottom end and having a bottom face adapted to contact a heat source, said heat sink member further having a top face directed toward said inner chamber, said top face being indented downwardly to define a fluid accumulating portion, wherein said top face has a central part and a peripheral end surrounding said central part, said top face being indented from said peripheral end to said central part so that said heat sink member decreases in thickness from said peripheral end to said central part, wherein said fluid accumulating portion of said heat sink member includes a plurality of spaced-apart downward slots formed in said top face, and wherein said heat transfer fluid in said fluid accumulating portion absorbs heat from the heat source and vaporizes to carry heat away from the heat source.

9. The heat pipe as claimed in claim 8, further comprising:

a cover member covering said top end, said cover member having an inner side facing said inner chamber, an outer side opposite to said inner side, and a filling hole formed in said cover member, in fluid communication with said inner chamber, and extending through said outer side; and an elastic sealing member fitted within said filling hole, wherein said elastic sealing member is pierceable to provide a passage for injection of said heat transfer fluid through said elastic sealing member, and is contractible to seal said passage.

10. The heat pipe as claimed in claim 8, wherein said peripheral wall of said tubular body has an inner surface formed with a capillary structure.

11. The heat pipe as claimed in claim 9, wherein said capillary structure includes a plurality of vertically and radially extending internal wicks.

12. The heat pipe as claimed in claim 9, wherein said capillary structure is a metal net connected fixedly to said inner surface of said peripheral wall.

13. The heat pipe as claimed in claim 9, wherein said capillary structure includes a plurality of spiral capillary grooves.

* * * * *